US009770107B2

(12) United States Patent
Glöckl

(10) Patent No.: US 9,770,107 B2
(45) Date of Patent: Sep. 26, 2017

(54) SEATING HAVING AN ANTI-ROTATION SYSTEM

(71) Applicant: aeris GmbH, Haar bei München (DE)

(72) Inventor: Josef Glöckl, Kirchheim (DE)

(73) Assignee: aeris GmbH, Haar bei München (DE)

( * ) Notice: Subject to any disclaimer, the term of this patent is extended or adjusted under 35 U.S.C. 154(b) by 48 days.

(21) Appl. No.: 14/433,830

(22) PCT Filed: Oct. 10, 2013

(86) PCT No.: PCT/EP2013/071110

§ 371 (c)(1),
(2) Date: Apr. 16, 2015

(87) PCT Pub. No.: WO2014/060273

PCT Pub. Date: Apr. 24, 2014

(65) Prior Publication Data

US 2015/0250317 A1 Sep. 10, 2015

(30) Foreign Application Priority Data

Oct. 19, 2012 (EP) ..... 12189319

(51) Int. Cl.
*A47C 3/18* (2006.01)
*A47C 9/00* (2006.01)
(Continued)

(52) U.S. Cl.
CPC ..... *A47C 3/18* (2013.01); *A47C 3/026* (2013.01); *A47C 3/22* (2013.01); *A47C 3/30* (2013.01); *A47C 7/004* (2013.01); *A47C 9/002* (2013.01)

(58) Field of Classification Search
CPC ..... A47C 9/002; A47C 9/025; A47C 3/026
See application file for complete search history.

(56) References Cited

U.S. PATENT DOCUMENTS 5,524,967 A * 6/1996 Glockl ..... A47C 9/002 248/372.1
5,749,557 A * 5/1998 Chang ..... A47C 3/24 248/405

(Continued)

FOREIGN PATENT DOCUMENTS

DE 73 11 140 U 7/1973
EP 1 774 871 A1 4/2007

(Continued)

*Primary Examiner* — Charles A Fox
*Assistant Examiner* — Christopher E Veraa
(74) *Attorney, Agent, or Firm* — Dickinson Wright PLLC

(57) ABSTRACT

The invention relates to an active dynamic seating (1) comprising a foot part (2) and a pendulum joint (10) which is rotatably mounted relative to the foot part (2), a seat (3) which is rotatably mounted relative to the foot part (2), and a pendulum column (4) supporting the seat (3), said pendulum column (4) being connected for conjoint rotation with the pendulum joint (10). The pendulum column (4) is designed to be resilient in a height direction H and the pendulum column (4) is provided with anti-rotation means (51, 52, 53) which rotationally immobilize the pendulum column (4) relative to the seat (3) such that the pendulum column (4) and the seat (3) can be rotated relative to the foot part (2) only together with the rotatable pendulum joint (10).

16 Claims, 8 Drawing Sheets

(51) Int. Cl.

| | |
|---|---|
| ***A47C 3/22*** | (2006.01) |
| ***A47C 3/30*** | (2006.01) |
| ***A47C 7/00*** | (2006.01) |
| ***A47C 3/026*** | (2006.01) |

(56) References Cited

U.S. PATENT DOCUMENTS

| | | | | |
|---|---|---|---|---|
| 6,003,944 | A * | 12/1999 | Glockl | A47C 3/18 297/313 |
| 7,547,067 | B2 * | 6/2009 | Keilhauer | A47C 3/02 297/313 |
| 8,066,624 | B1 * | 11/2011 | Stroup | A47C 7/004 297/338 |
| 2006/0138840 | A1 | 6/2006 | Keilhauer et al. | |
| 2008/0143162 | A1 * | 6/2008 | Glockl | A47C 3/026 297/362.13 |

FOREIGN PATENT DOCUMENTS

| | | | |
|---|---|---|---|
| GB | 2 230 696 | A | 10/1990 |
| WO | 2010/136312 | A1 | 12/2010 |

* cited by examiner

B-B (1:1)

C-C (1:1)

B-B (1:2)

C-C (1:2)

D-D (1:2)

SEATING HAVING AN ANTI-ROTATION SYSTEM

The invention relates to a seating, in particular to an actively dynamic seating in accordance with claim 1. The invention relates in particular to an actively dynamic seating having an anti-rotation protector.

In the art, various seatings are known which are designed in such a way that the body sits in a position which is as anatomically comfortable as possible as a result of correspondingly configured seat faces and backs. Although seatings of this type are often perceived as pleasant and comfortable, they have decisive drawbacks.

Sitting on seatings of this type involves passive sitting; in other words, there is little or no strain on the back muscles, and the vertebral discs are statically compressed. This may result in wearing of the spinal disc, degeneration of the back muscles and harm to health, as well as pain.

Therefore, dynamic, in particular actively dynamic seat devices have been developed, which make actively dynamic sitting possible, as opposed to passive sitting. During actively dynamic sitting, the back muscles and vertebral discs are always slightly active. During sitting on an actively dynamic seat device, the seat user is always required to balance out the equilibrium and to tilt the body constantly backwards and forwards, and thus carry out pendulum movements of the seat, in the same way as when walking upright. Thus, both the legs and the entire upper body interact constantly or at least regularly, and the muscle groups involved are thus actively actuated. Furthermore, the seat user is urged always to sit upright and to change posture regularly, meaning that the vertebral discs are subjected to a changing rather than a static load and are supplied with nutrients.

DE-GM 731114 discloses an actively dynamic seat device comprising a seat part which is connected via a first tilt articulation to a support shaft, the support shaft in turn being articulated at the foot part of the seat device via a second tilt articulation. In this context, each tilt articulation preferably consists of a cup, which is formed on the respective end of the support shaft, is guided in a hollow cylinder, and is loaded by a coil spring arranged in the hollow cylinder.

A further seat device is known from DE-GM 1829791. This seat device is in the form of a swinging chair, and accordingly comprises a seat which is pivotable back and forth. The seat itself is rigidly connected to an intermediate part and a foot part, the intermediate part being pivotally mounted on the foot part.

DE-GM 1787342 discloses a further seating possibility, which is formed as a one-legged seat. This one-legged seat comprises a foot part, an intermediate part and a seat part. A spring element is arranged between the foot part and the intermediate part, and makes it possible for the intermediate part to swing or oscillate out of the normal position together with the seat part. As a result, the seat user can swing back and forth between the normal position and the deflected position.

In actively dynamic seatings, it is necessary for the seat user to be able to use the seating without risk. In particular, when swinging backwards, the seat user should be prevented from falling off the seat or even tipping over together with the entire seating.

For this purpose, a seating is proposed comprising an apparatus for defining a rearward direction R, in which it is possible to deflect the pendulum joint to different extents depending on the relative deflection direction with respect to the orientation of the apparatus and a safety apparatus being provided which makes a smaller or limited deflection of the pendulum column possible in the rearward direction by comparison with other directions.

An actively dynamic seating of this type, provided with a safety device, thus makes a restricted pendulum movement possible in at least one direction, in particular in a rearward direction. If a seating of this type comprises for example a backrest and if the seat user leans against the backrest, the seat can only complete a small rearward deflection, ensuring that the user will not tip over backwards.

However, in seatings of this type there is the problem that when the seat is rotated the position of the safety device also changes. If the seat user rotates the rotatably mounted seat for example through 90° or 180°, the position having the restricted deflection likewise changes relatively by the same angle. It is thus no longer ensured that the rearward deflection limited by the safety apparatus is located in a position rotated by the angle of rotation rather than in the rearward position.

However, there is a need for actively dynamic seatings in which the seat is mounted freely rotatably and the seat user would like to use the seating safely irrespective of the relative position of the seat.

The object of the invention is therefore to provide an actively dynamic seating comprising a rotatable seat, which makes risk-free use of the seating possible, it being intended for the actively dynamic seating to be of a simple constitution and to be easy for the seat user to use.

This object is achieved by a seating according to claim 1. The basic idea of the present invention is to provide a seating, in particular an actively dynamic seating, comprising a rotatable seat and a pendulum column, anti-rotation means being provided on the pendulum column and fixing the pendulum column in a rotationally engaged manner with respect to the seat in such a way that the pendulum column and the seat can only be rotated with respect to the foot part together with the rotatable pendulum joint. If a pendulum joint is used with a safety apparatus as disclosed above, this ensures that, irrespective of the rotational orientation thereof, the seat can only be deflected rearwards by the deflection limited by the safety device.

Therefore, according to the invention, a seating, in particular an actively dynamic seating, is provided, which comprises the following:

a foot part comprising a pendulum joint which is mounted rotatably with respect to the foot part, a seat which is mounted rotatably with respect to the foot part, a pendulum column which carries the seat, the pendulum column being rotationally engaged with the pendulum joint, the pendulum column being formed resiliently in the vertical direction H, and anti-rotation means according to the invention being provided on the pendulum column and fixing the pendulum column in a rotationally engaged manner with respect to the seat in such a way that the pendulum column and the seat can only rotate with respect to the foot part together with the rotatable pendulum joint.

According to the invention, the anti-rotation means are provided on the pendulum column in such a way that the seat, the pendulum column and the pendulum joint are interconnected so as to be rotationally engaged, and as a result, when the seat is rotated through an angle $\alpha$, the pendulum joint is automatically rotated together therewith through the same angle $\alpha$ and it is thus always ensured that the (limited) rearward deflection possibility is provided in a particular direction. It is therefore advantageous to provide an apparatus for defining the rearward direction, which is particularly preferably arranged on the seat.

Preferably, the pendulum column of the seating according to the invention further comprises the following:

a tubular bearing bush, a spring leg, which can move up and down in the bearing bush and which comprises a pneumatic spring, and a coil spring, which is arranged between an upper and lower spring seat of the pendulum column. It is advantageous for the height of the lower spring seat to be adjustable.

The pneumatic spring ensures that on the one hand the seat height is continuously adjustable, whilst on the other hand the spring characteristic (spring hardness) of the resilient pendulum column can be adjusted by way of the coil spring. By screwing the lower spring seat together relative to the upper spring seat, the spring force of the coil spring arranged between them can be adjusted.

It is advantageous for the pendulum column to further comprise, on the lower end, a tubular bearing bush which is connected to a supporting leg and via the supporting leg to the pendulum joint, the spring leg which can move up and down preferably passing through the bearing bush. In a particularly advantageous configuration of the invention, the connection between the bearing bush and the supporting leg is configured as a conical connection. More advantageously, a plurality of bearing rollers, along which the spring leg can move up and down, are arranged inside the bearing bush. Preferably, an upper and a lower bearing roller plane are provided, in which a plurality of radially circulating bearing rollers are arranged on bearing cages within the bearing bush in such a way that fluid up-and-down movement is ensured.

In one embodiment according to the invention, an anti-rotation means extending in the vertical direction H is arranged externally on the spring leg, and is mounted on bearing-bush-side anti-rotation means in a rotationally engaged manner in such a way that the spring leg can carry out an up-and-down movement in the vertical direction H but not a rotational movement in the bearing bush. Since, as part of the pendulum column, the spring leg is rotationally engaged with the seat, an anti-rotation system of this type ensures that the spring leg and thus the seat connected to the spring leg can only rotate together with the pendulum joint.

It is advantageous for at least one of the bearing-bush-side anti-rotation means to be in the form of a rotatable bearing roller which is mounted in a roller cage.

It is further advantageous for the anti-rotation means to be provided with at least one guide face which is in contact with a roller end face of one of the rollers.

In a particularly preferred embodiment, the preferably two bearing-bush-side anti-rotation means are each formed with a bearing roller rotatably mounted on a roller cage and having opposite roller end faces, and the preferably two lateral guide faces of the anti-rotation means are arranged between the roller end faces of the bearing rollers. In this way, the lateral guide faces of the anti-rotation means extending in the vertical direction H can be braced against the roller end faces of the bearing rollers during the up-and-down movement, and anti-rotation protection is provided over the entire vertical movement (height H) of the anti-rotation means.

This has the advantage that the spring leg can carry out a movement within the bearing bush in the vertical direction H, but, as a result of the anti-rotation means, rotational movement is prevented over the entire height of the anti-rotation means extending in the vertical direction H.

Preferably, a plurality of bearing rollers are arranged in the bearing bush in such a way that the roller end faces thereof are positioned against the outer surface of the spring leg, preferably without play, and the axes of rotation A thereof are each perpendicular to the vertical direction H in such a way that the spring leg can be actuated up and down along the bearing rollers in the vertical direction H.

In a particularly advantageous embodiment, the components used are matched to one another, in terms of the tolerance positions thereof, in such a way that on the one hand it is possible to actuate the movable parts without play and at the same time rattling or jerking of the movable parts is prevented.

It is therefore advantageous for the pneumatic spring to be enclosed at least in part by a tubular adapter and to be non-positively connected thereto. As a tubular adapter, it is particularly advantageous for an aluminum tube, preferably a precision aluminum tube, to be used, the outer circumference of which takes on a predetermined level of precision and on the inner wall of which plastically deformable structures are formed, by means of which the tubular adapter is fixed non-positively on the outer surface of the pneumatic spring. It can thus be ensured that the tolerances occurring in the outer circumference of the pneumatic spring are compensated.

In a particularly favourable form of use, the pneumatic spring comprises a first (lower) portion, on which the pneumatic spring is enclosed by a tubular adapter, and a second (upper) portion, on which the pneumatic spring is rotationally engaged with the seat carrier of the seat.

In a further advantageous embodiment, the tubular adapter is positively enclosed by a metal sliding tube, for example a stainless steel tube, and is rotationally engaged therewith, the lower opening thereof preferably being sealed with a metal disc as a central shaft and an end of the pneumatic spring being fixed thereto. This prevents a rotational movement of the pneumatic spring.

The spring leg preferably comprises the pneumatic spring, the adapter and the sliding tube enclosing the adapter, which are all rotationally engaged with one another. As a result of the above-disclosed configuration of the spring leg, the positions of the bearing rollers merely have to be matched to the outer diameter of the sliding tube.

In a particularly advantageous embodiment, the tubular bearing bush is conical in form. The bearing cages of the bearing rollers thus project different distances from the inner surface of the conical bearing bush, whilst the end faces of the bearing rollers of all of the bearing rollers in a roller tier are positioned as points on a circle having a diameter D corresponding to the external diameter D of the sliding tube.

It is advantageous for the pendulum column to have a coil spring which is arranged between an upper and a lower spring seat, the lower spring seat being formed with a thread which cooperates with a thread on the supporting leg and is fixed thereto. Since the height of the lower spring seat is adjustable, the spring force of the coil spring can thus be adapted individually for each seat user.

In a further advantageous embodiment of the invention, the seat has an apparatus for defining the rearward direction R. The pendulum joint can be deflected to different extents relative to the orientation of the apparatus for defining the rearward direction. Preferably, in the rearward direction a safety apparatus is provided which makes a smaller deflection of the pendulum column possible by comparison with different (other) directions. As a result of an apparatus of this type, the seat user can ensure that he is sitting in the correct orientation on the seat and specifically that his back is facing in the direction of the apparatus for defining the rearward direction.

Particularly advantageously, a backrest is suitable as the apparatus for defining the rearward direction R. In this way, a particularly reliable actively dynamic seating can be provided, which makes it possible for the seat user to carry out safe pendulum movements irrespective of the rotational position of the rotatable seat.

Advantageous embodiments of the invention are specified in the dependent claims and are described in more detail in the following by way of the disclosed embodiments with reference to the drawings, in which:

Figure 2:
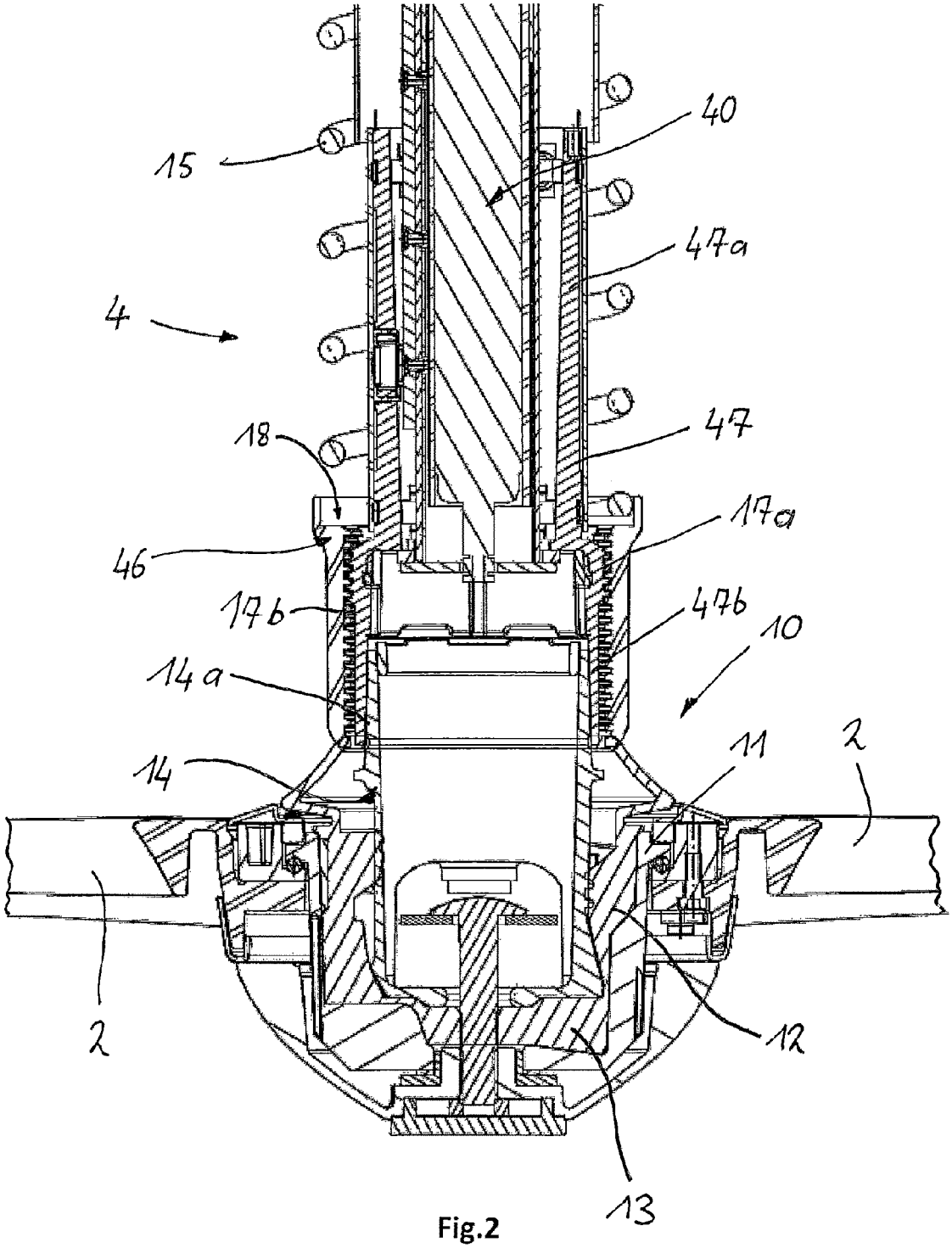
FIG. 2 is a sectional view of a detail of the connection of the pendulum column to the pendulum joint and to the foot part.
Figure 2A:
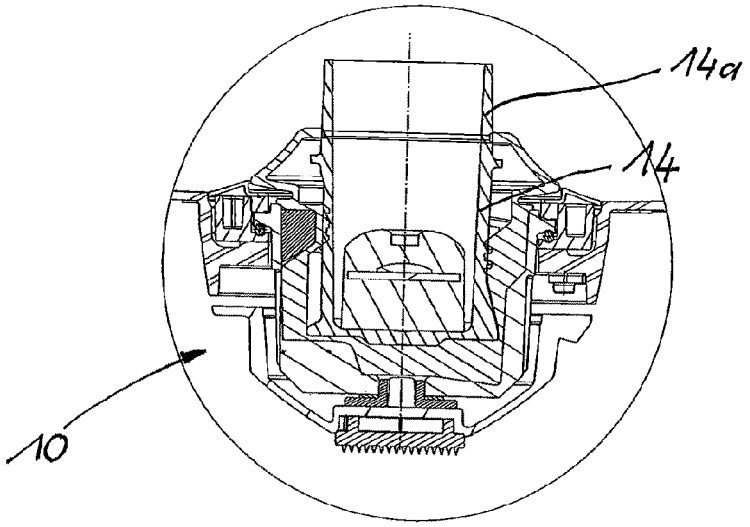
Figure 2B:
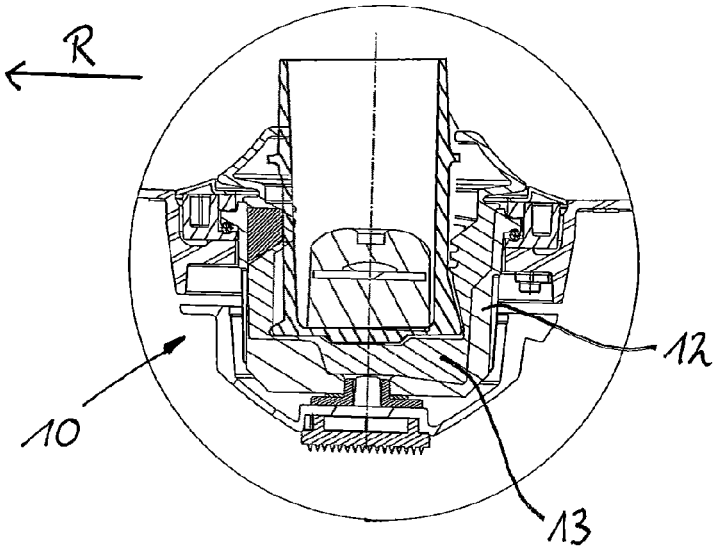
Figure 2C:
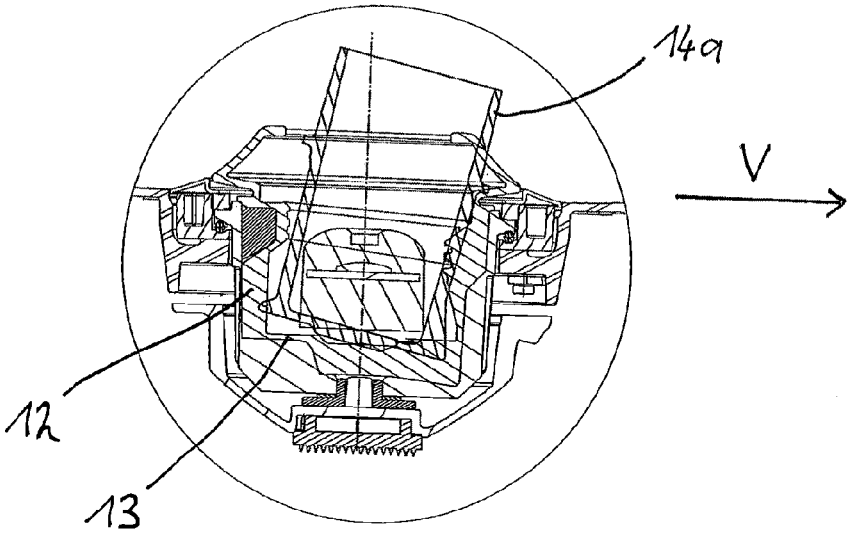
Figure 3:
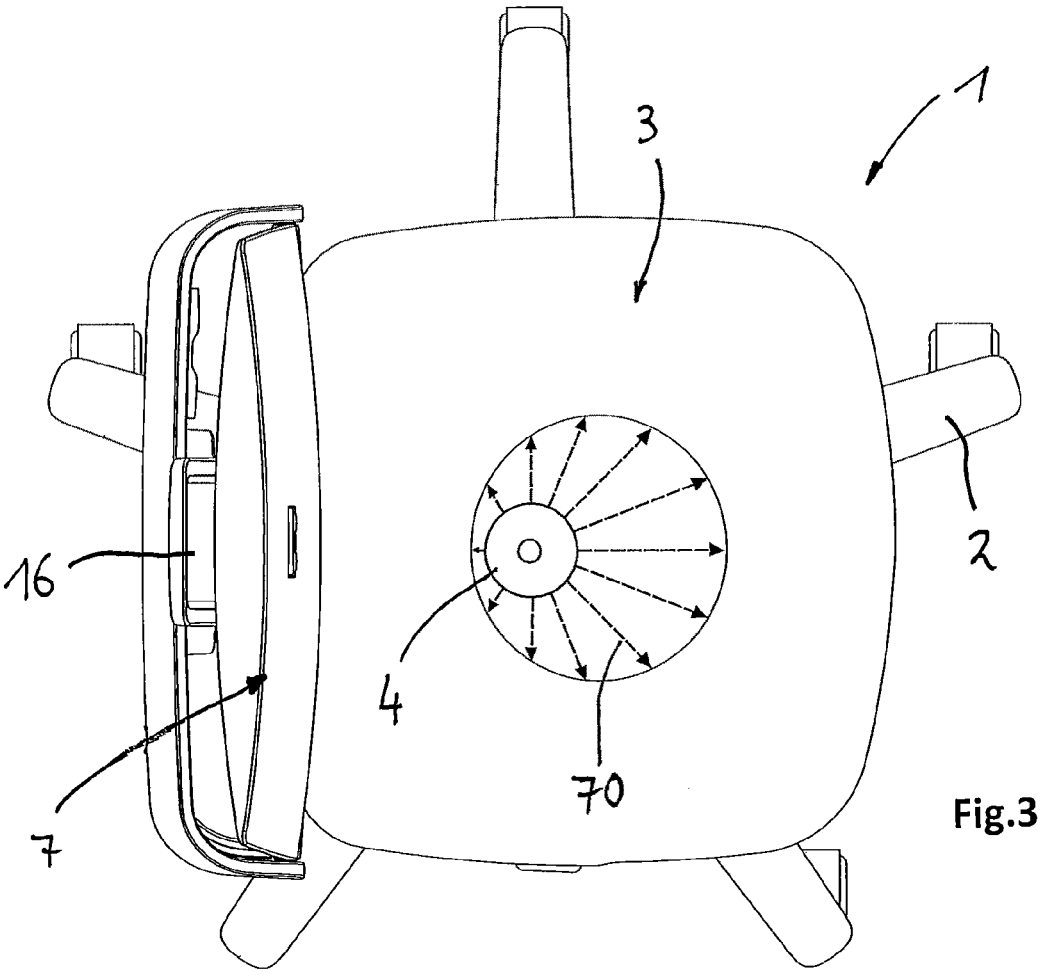
Figure 3A:
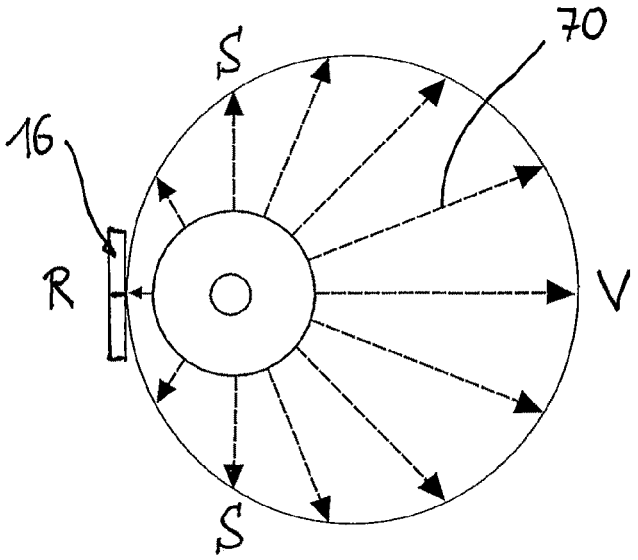
Figure 4:
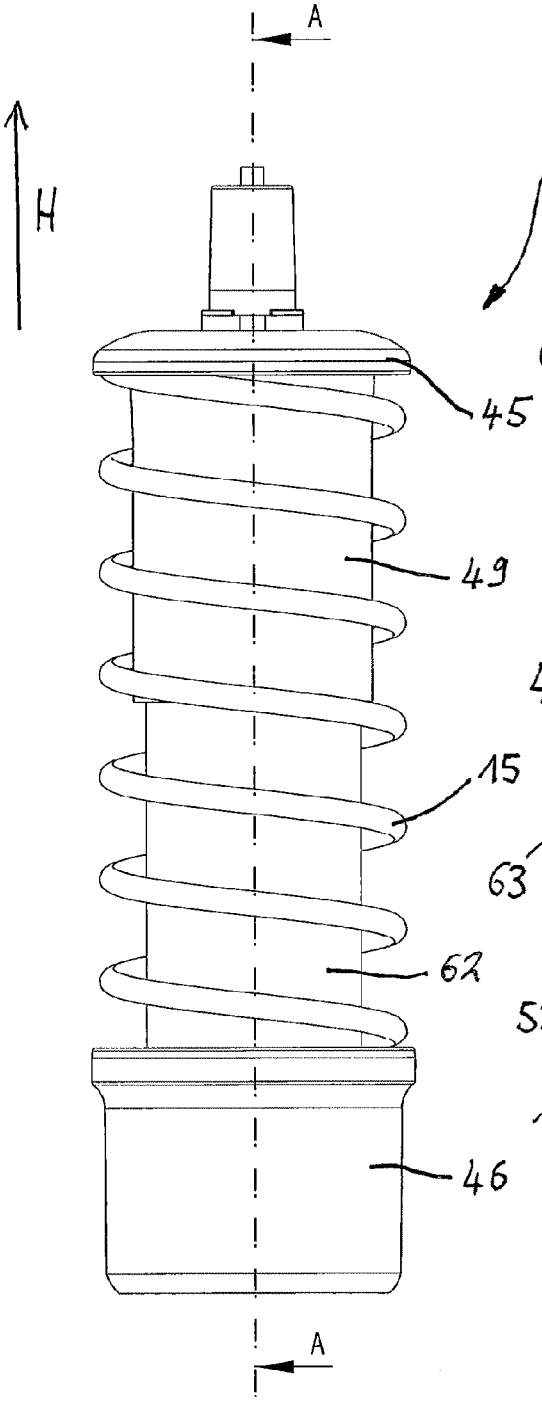
Figure 4A:
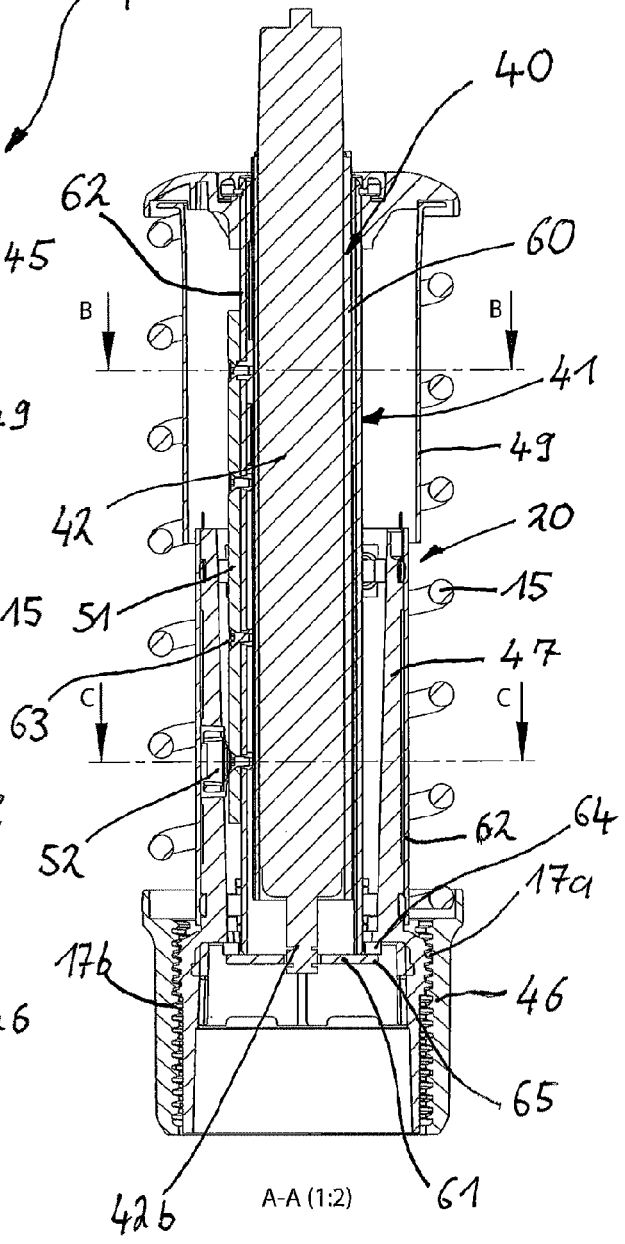
Figure 4B:
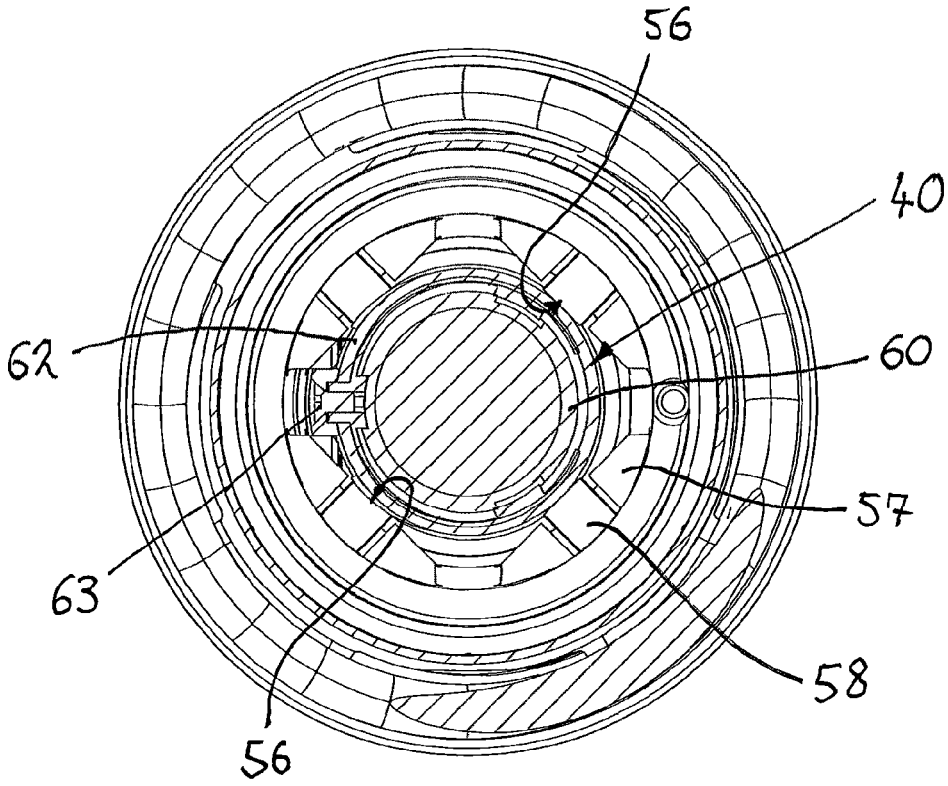

FIG. 2*a* is a sectional view through the pendulum joint in an undeflected position;

FIG. 2*b* is a view similar to FIG. 2*a*, in which the pendulum column is deflected rearwards;

FIG. 2*c* is a view similar to FIG. 2*b*, in which the pendulum column is deflected forwards;

FIG. 3 is a plan view of a chair with a set of deflection vectors;

FIG. 3*a* is a detail from FIG. 3;

FIG. 4 is a side view of a pendulum column;

FIG. 4*a* is a sectional view through a pendulum column along the section line A-A from FIG. 4;

FIG. 4*b* is a sectional view along the section line B-B from FIG. 4*a;*

Figure 4C:
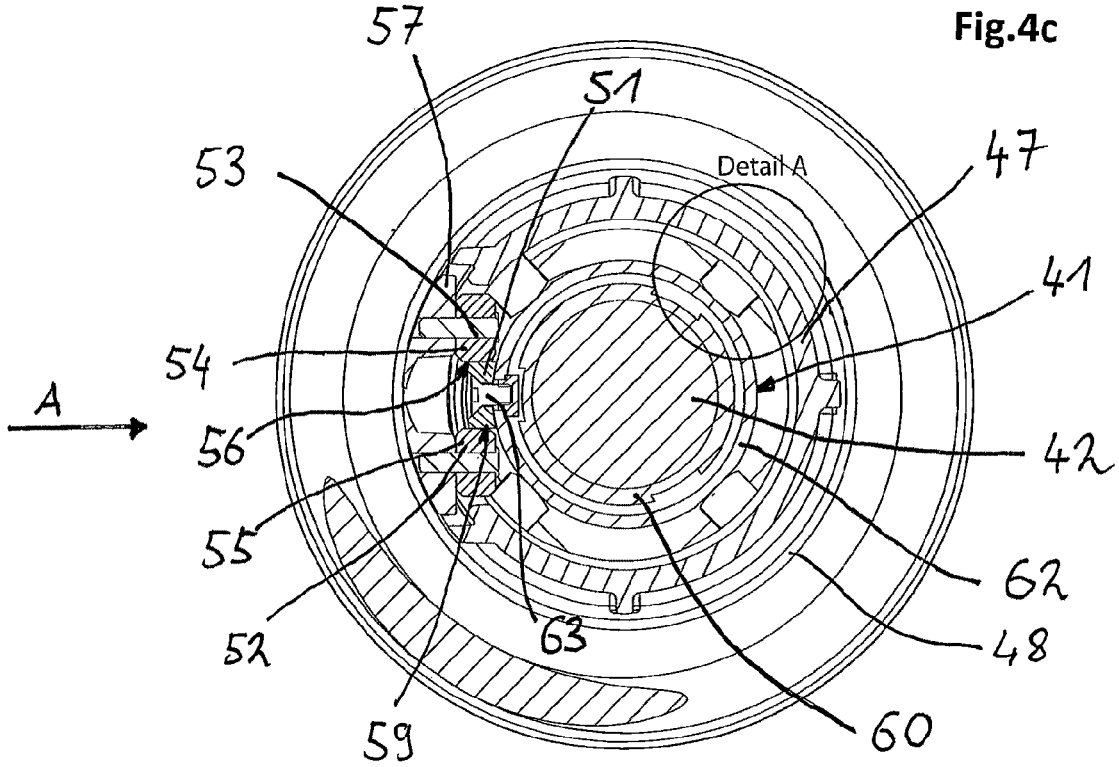

FIG. 4*c* is a sectional view along the section line C-C from FIG. 4*a;*

Figure 4D:
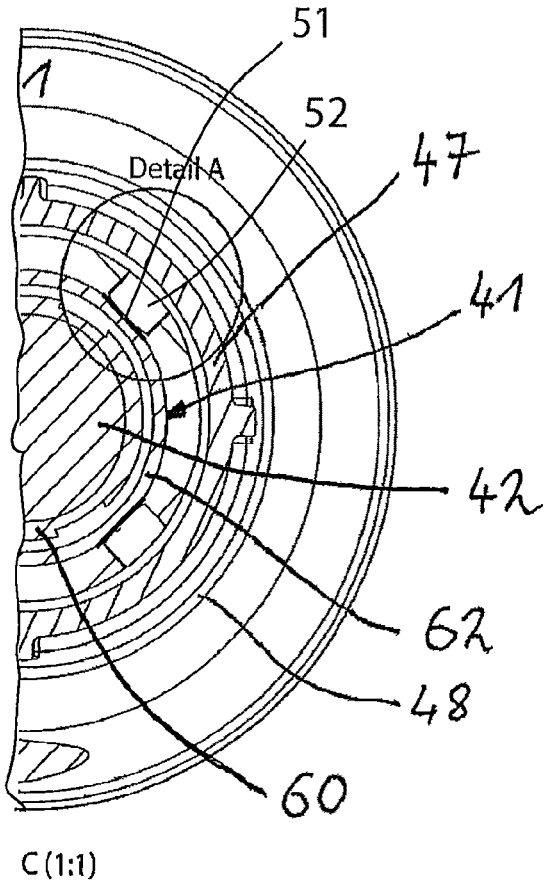
Figure 5:
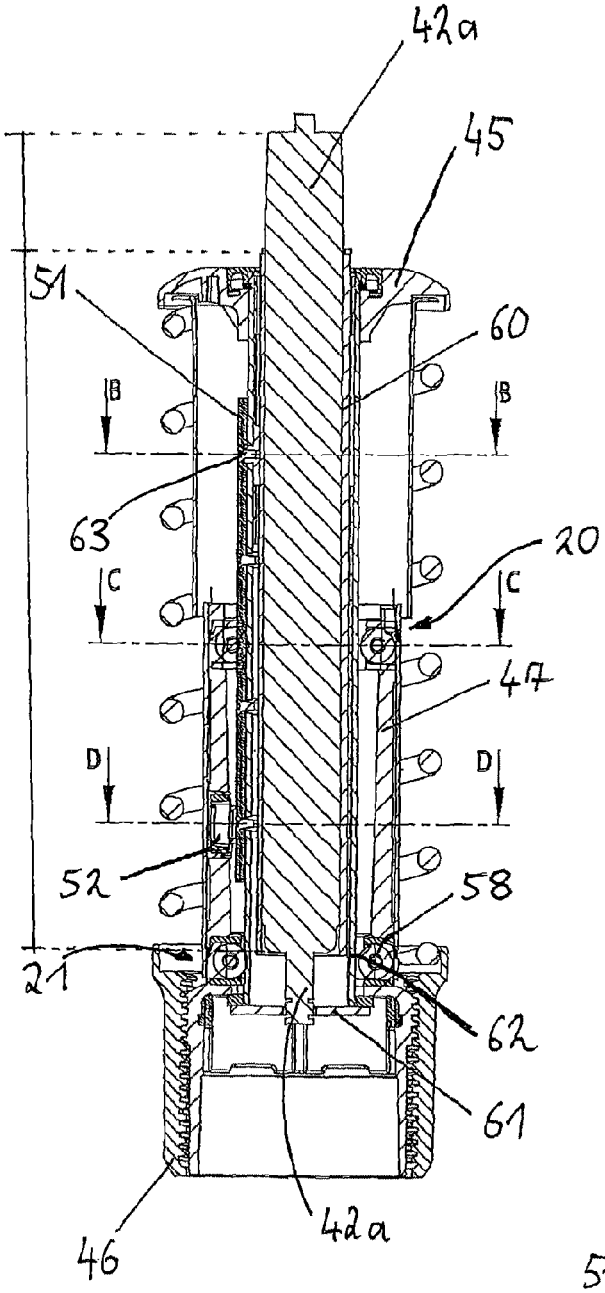

FIG. 4*d* is an alternative detail view of an anti-rotation system;

FIG. 5 is a sectional view similar to FIG. 4*a;*

Figure 5A:
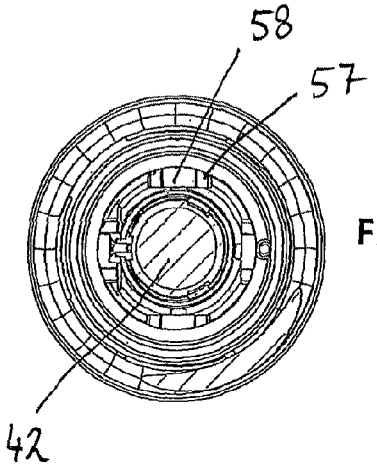
Figure 5B:
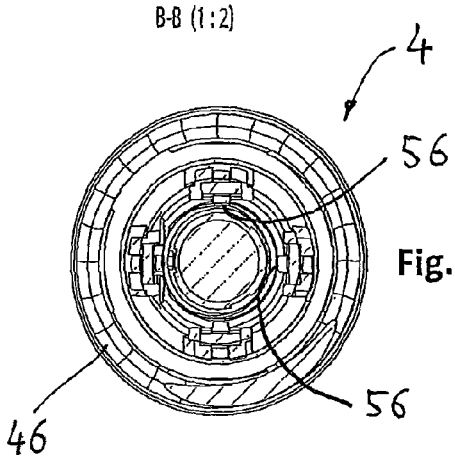
Figure 5C:
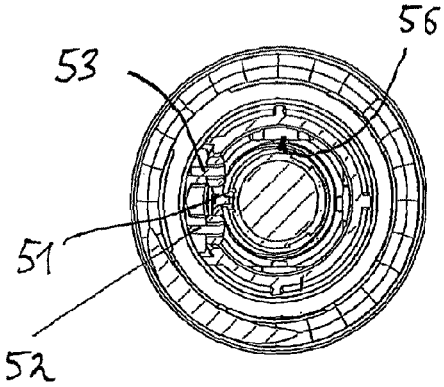

FIG. 5*a* is a sectional view along the section line B-B from FIG. 5;

FIG. 5*b* is a sectional view along the section line C-C from FIG. 5;

FIG. 5*c* is a sectional view along the section line D-D from FIG. 5.

Figure 1:
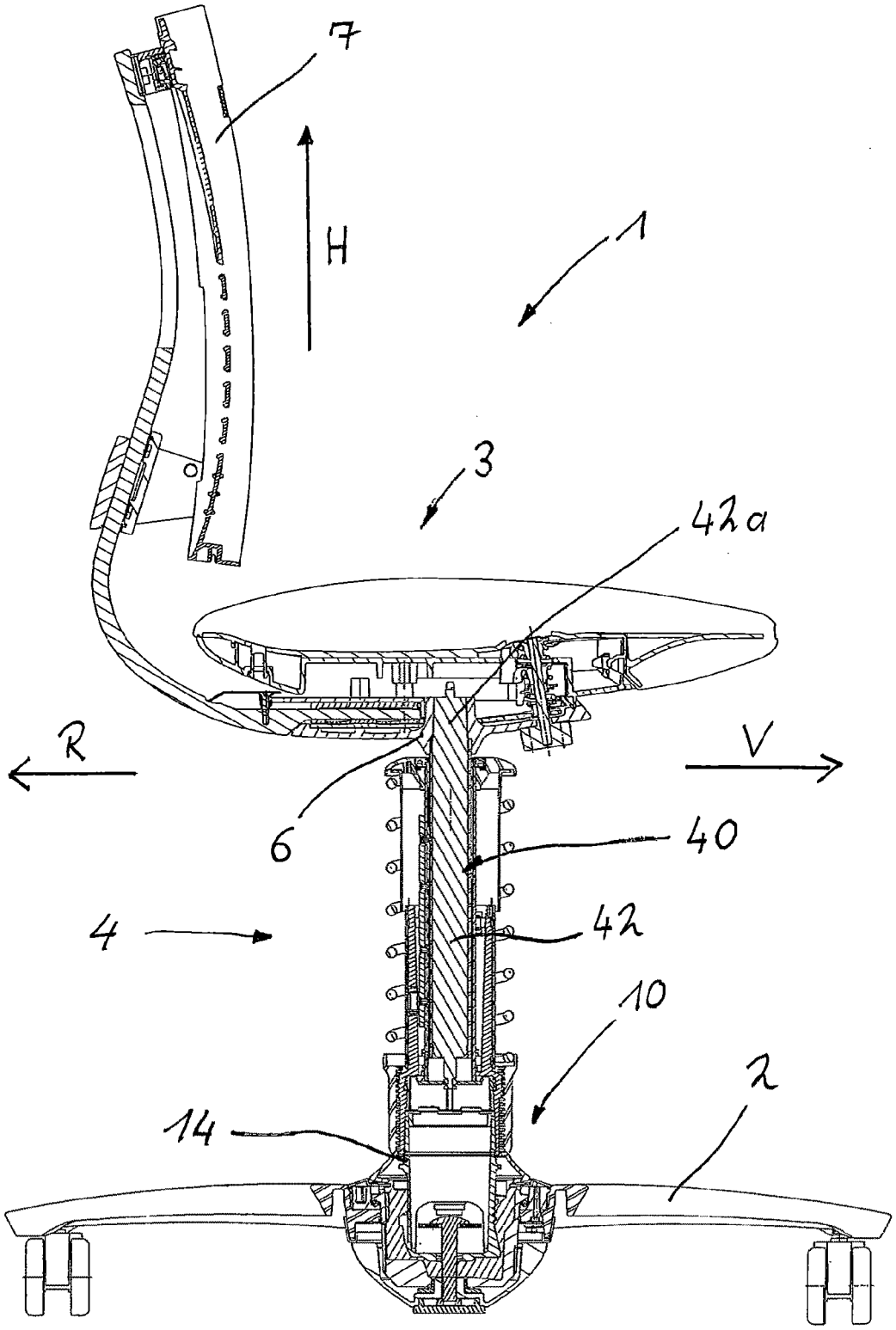
FIG. 1 is a lateral sectional view of an actively dynamic seating comprising a pendulum column.

The sectional view of FIG. 1 shows a first embodiment according to the invention of an actively dynamic seating 1. The seating 1 comprises a foot part 2 having a pendulum joint 10 mounted on the foot part 2. The pendulum joint 10 is rotatably mounted on the foot part 2. The seating 1 further comprises a rotatably mounted seat 3, which is formed rotatably with respect to the foot part 2. The seat 3 is carried by a pendulum column 4, the pendulum joint 10 being rotationally engaged with the pendulum column 4. The pendulum joint 10 is formed as a multi-directional pendulum joint 10 in the present embodiment. This means that pendulum movements are possible in a forward direction, rearward direction and lateral direction and in any directions positioned therebetween. The multi-directional pendulum joint is generally referred to as a pendulum joint 10 in the following. The pendulum column 4 shown in FIG. 1 is formed resiliently in the vertical direction H. The pendulum column 4 shown in FIG. 1 is resilient in the vertical direction H. The pendulum column 4 is connected to the pendulum joint 10 via a supporting leg 14. Below the seat 3 there is a seat carrier 6, which is rotationally engaged with the pendulum column 4.

It can further be seen that a pneumatic spring 42 is arranged inside the pendulum column 4 so as to be able to adjust the height of the rotatable seat 3. In this case, the upper end 42*a* of the pneumatic spring 42 is rotationally engaged with the seat carrier 6. In the present embodiment, the rotational engagement by positive and non-positive connection between the outer surface of the pneumatic spring 42 and the inner surface of a receiving cylinder has been provided on the seat carrier 6.

A backrest 7 is further fixed to the seat 3. In the present case, the backrest 7 is rotationally engaged with the seat carrier 6. This means that when the seat 3 is rotated, the backrest 7 is always moved together therewith.

Within the meaning of the present invention, "rotational engagement" refers to any connections in which two adjacent components are interconnected in such a way that a positive, material or non-positive connection is provided or alternatively the connected components are mechanically interconnected in such a way that the rotation of one component through an angle $\alpha$ is linked to the rotation of the second component through the same angle $\alpha$.

FIG. 2 shows a detail from FIG. 1. The detail shows the foot part 2, along with the pendulum joint 10, and the lower part of the pendulum column 4. The pendulum joint 10 is mounted so as to be rotatable with respect to the foot part 2. The foot part 2 further comprises a receiving cup 11, specifically a rigid receiving cup 11. A resilient articulation bowl 12 is arranged in the receiving cup 11. The supporting leg 14 is introduced in the articulation bowl 12 in such a way that the supporting leg 14 can carry out pendulum movements inside the articulation bowl 12, such as are disclosed in greater detail in FIG. 2*a* to 2*c*. On the upper end thereof, the supporting leg 14 comprises a supporting leg termination 14*a*. In the present case, the upper end of the supporting leg termination 14*a* is conical in form. The articulation bowl 12 has a deflection limiting system 13. The functionality of the deflection limiting system 13 is described in greater detail in connection with FIG. 3 and FIG. 3*a*.

As can be seen from FIG. 2, the lower end of the pendulum column 4 is connected to the supporting leg termination 14*a* via a conical connection. The connection is provided via a substantially tubular bearing bush 47, which is formed open on both sides. In the present embodiment, the lower bearing bush portion of the bearing bush 47 and the upper bearing bush portion of the bearing bush 47 are each conical in form. The lower bearing bush portion 47*b* comprises a thread 17*a*, which can also be seen in the embodiments of FIG. 4*a* and FIG. 5, on the outer surface thereof. A lower spring seat 46 comprising an internal thread 17*b* is screwed onto the outer thread 17*a* on the bearing bush 47. The lower spring seat 46 has an abutment 18 on the upper face thereof for receiving a coil spring 15. As can be seen in FIG. 2, the lower end of the coil spring 15 is positioned in the abutment 18, which is in the form of a groove. The lower end of a spring leg 40 is passed through the bearing bush 47. The spring leg 40 is subsequently disclosed in detail in connection with FIG. 4*a* and FIG. 5.

FIG. 3 shows an actively dynamic seating 1 from above. In particular, the seat 3 and the backrest 7 as well as the foot part 2 can be seen. A set of deflection vectors 70 of the pendulum column 4 are shown in the seat 3 by way of example. The length and thus the magnitude of each deflection vector 70 specifies the maximum possible deflection in each of the vector directions shown. As can be seen in the detail in FIG. 3*a*, the direction to the left is denoted as the rearward direction R, and the opposite direction to the right is denoted as the forward direction V. An apparatus 16 for defining the rearward direction R is further specified, and in this case is formed as a backrest 7 or part of the backrest 7. The arrows directed vertically upwards and downwards in FIG. 3*a* indicate the possible deflections in the lateral direction S of the pendulum column 4. A minimum deflection is possible in the rearward direction R, whilst a maximum deflection is possible in the forward direction V. All of the deflections positioned between the rearward direction and the forward direction make a continuously increasing deflection possible, which is represented by the deflection vectors 70. The apparatus 16 for defining the rearward direction provides that a seat user can reliably establish in which position he should sit down on the seating 1. If the right seat position is assumed, the actively dynamic seating 1 according to FIG. 3 can be used so as to swing in accordance with the set of vectors in FIG. 3*a*. The seat user can therefore carry out pendulum movements to the rear (in the rearward direction R) and in any other desired direction. If he leans forward in the forward direction V, he can thus bring about a defined maximum deflection of the pendulum column 4. In the present embodiment according to FIG. 3, the apparatus 16 for defining the rearward direction R is a backrest 7.

FIG. 2*a* to 2*c* show, by way of example, various deflections of the pendulum column 4 or of the supporting leg termination 14*a* which is connected to the pendulum column 4. In FIG. 2*a*, the pendulum joint 10 and thus the supporting leg termination 14*a* are shown in a vertical undeflected position. Meanwhile, FIGS. 2*b* and 2*c* respectively show a pendulum movement to the rear and to the front. By forming the deflection limiting system 13 of the articulation bowl 12 in a suitable manner, as shown for example in FIG. 2, the deflection in a particular direction such as the rearward direction R can be limited. Accordingly, the deflection limiting system 13 has the function of preventing the pendulum column 4 from being limited to a defined extent in said direction, in such a way that the seat user is prevented from tilting on the stool.

For the apparatus 16 for defining the rearward direction R to also always actually be located in correspondence with a deflection limiting system 13, it has to be ensured that the seat 3 comprising the pendulum column 4 and the apparatus 16 can only rotate together with the deflection limiting system 13 and thus together with the pendulum joint 10. For this purpose, anti-rotation means 51, 52, 53 according to the invention are provided on the pendulum column 4. FIG. 4 is a side view of an embodiment of a pendulum column 4, which is formed resiliently in the vertical direction H. Inside the pendulum column 4 there is a spring leg 40. The pendulum column 4 further comprises an upper spring seat 45, which is connected to a tube part 49, and a lower spring seat 46. A coil spring 15 is arranged between the upper spring seat 45 and the lower spring seat 46. The coil spring 15 can be biased more or less strongly by a rotatable adjustment of the lower spring seat 46. As shown in FIG. 4*a*, the height of the lower spring seat 46 can be adjusted with respect to the bearing bush 47 by way of the threads 17*a*, 17*b*.

The spring leg 40 comprises the pneumatic spring 42, which is enclosed by the tubular adapter 60. On the inner face thereof, the tubular adapter 60 comprises structures (not shown) by way of which it has been pressed onto the outer surface of the pneumatic spring 42. As a result, the structures have been plastically deformed and a positive and non-positive connection is produced between the adapter 60 and the pneumatic spring 42. A sliding tube 62 is arranged around the adapter 60 and is fixed to the adapter 60 so as to be rotationally engaged with respect to the pneumatic spring 42. FIG. 5 shows that the pneumatic spring 42 comprises a first portion 43, at which the pneumatic spring 42 is enclosed by the tubular adapter 60, and a second portion 43, at which the pneumatic spring 42 is rotationally engaged with a seat carrier 6 of the seat 3.

The spring leg 40 is guided so as to be movable up and down in the bearing bush 47. On the outer surface 41, an anti-rotation means 51 extending in the vertical direction H is screwed to the sliding tube 62 by way of screws 63. The anti-rotation means 51 cooperates with bearing-bush-side anti-rotation means 52 and 53, and prevents the spring leg 40 from rotating with respect to the bearing bush 47, as shown in greater detail in FIG. 4*c*.

FIG. 4*c* is a sectional view along the section line C-C from FIG. 4*a*. The anti-rotation means 51 is screwed to the sliding tube 62, and projects in the manner of a web from the outer surface 41 thereof. As in the embodiment shown in FIGS. 4*a*, 4*b* and 4*c*, the anti-rotation means 51 forms a web extending over the height H. The anti-rotation means 51 is arranged between two bearing-bush-side anti-rotation means 52 and 53, and the lateral guide faces 59 thereof are positioned against the anti-rotation means 52, 53. The anti-rotation means 52, 53 used in this embodiment form bearing rollers 54, 55, which are fixed to the bearing bush 47 via roller cages 57. The axis-of-rotation direction A is orientated in this case in such a way that the roller end faces 56 of the bearing rollers 54, 55 can be actuated along the guide faces 59. This ensures that the spring leg 40 can carry out an up-and-down movement in the vertical direction H but not a rotational movement with respect to the bearing bush 47. The spring leg 40 is further guided inside the bearing bush 47 by a plurality of bearing rollers 58. The present embodiments comprise an upper roller tier 20 and a lower roller tier 21, in which a plurality of bearing rollers 58 in roller cages 57 are fixed such that they circulate. It can further be seen in FIG. 5 that in the upper roller tier position 20, as a result of the conical shape of the bearing bush 47, the upper bearing rollers 58 project further from the inner surface of the bearing bush 47. In the present embodiment, four bearing rollers 58 are arranged in each case so as to be diametrically opposite in the respective upper roller tier 20 and the respective lower roller tier 21, two opposing roller end faces 56 of the opposing bearing rollers 58 being spaced apart at a distance corresponding to the external diameter of the sliding tube 62. In this way, the sliding tube 62 is guided between the bearing rollers 58 without play. FIG. 4*b* and FIG. 5*a* to 5*c* are different sectional views through the pendulum column 4. In FIG. 4*c*, it can further be seen that a support tube 48 is arranged about the bearing bush 47. Alternatively, the bearing rollers 58 can be held completely by the bearing bush 47, it thus being possible for the support tube 48 to also be arranged around the bearing bush 47 as a decorative tube for example.

FIG. 4*d* shows an alternative detail of an anti-rotation system 51, 52. In this case, as simple an embodiment as possible of the anti-rotation system 51, 52 is selected. In this case, the anti-rotation system acts between flattened portions 51 on the outer surface of the sliding tube 62 and corresponding counter bearings 52, which in the present case cooperate with the roller end face 56 of a bearing bush 58 in such a way that rotation is prevented. As a result of the outer contour provided with flattened portions, a non-circular envelope of the sliding tube is provided which prevents the sliding tube from rotating about its own axis. In this way, an alternative anti-rotation system can be provided using simple means.

FIG. 5*c* shows an alternative embodiment of the bearing rollers 54, 55 as anti-rotation means 52, 53. The anti-rotation means 52, 53 are likewise formed as bearing rollers 54, 55. In this case, the axis of rotation of the bearing rollers 54, 55 extends towards the lateral guide faces 59 of the anti-rotation means 51. It is advantageous for a minimum play to be formed between the lateral faces of the bearing rollers 54, 55 of the anti-rotation means 52, 53 and the guide faces 59 of the anti-rotation means 51.

According to the invention, it is also possible for a plurality of anti-rotation means 51, 52, 53 to be arranged on the pendulum column 4, so as to ensure that if an anti-rotation means fails, a further anti-rotation means prevents the seat from rotating relative to the pendulum joint 10.

It can further be seen in FIG. 4*a* that the lower end of the pneumatic spring 42*b* is connected to a metal end plate 61. In the present case, the metal end plate 61 is further connected to the sliding tube 62. A collar 65 of the metal end plate 61 projects past the outer contour of the sliding tube 62. The collar 65 is braced in the bearing bush against a corresponding shoulder, a damping element 64 being arranged between the shoulder and the collar 65.

The configuration of the invention is not limited to the preferred embodiments disclosed above. Rather, a number of variants are conceivable, which make use of the solution shown even if the configurations are fundamentally different in nature. Further, details and combinations of preferred configurations form the subject matter of the invention.

LIST OF REFERENCE SIGNS

1 Seating
2 Foot part
3 Seat
4 Pendulum column
6 Seat carrier
7 Backrest
10 Pendulum joint
11 Receiving cup
12 Articulation bowl
13 Deflection limiting system
14 Supporting leg
14*a* Supporting leg termination
15 Coil spring
16 Apparatus for defining the rearward direction
17*a* Thread
17*b* Thread
18 Abutment
20 Upper roller tier
21 Lower roller tier
40 Spring leg
41 Outer surface
42 Pneumatic spring
42*a* Upper end of the pneumatic spring
42*b* Lower end of the pneumatic spring
43 First portion
44 Second portion
45 Upper spring seat
46 Lower spring seat
47 Bearing bush
47*a* Upper bearing bush portion
47*b* Lower bearing bush portion
48 Support tube
49 Tube part
51 Anti-rotation means
52 Anti-rotation means
53 Anti-rotation means
54 Bearing rollers
55 Bearing rollers
56 Roller end face
57 Roller cage
58 Bearing roller
59 Guide faces
60 Adapter
61 Metal end plate
62 Sliding tube
63 Screws
64 Damping element
65 Collar
70 Deflection vectors
A Axis-of-rotation orientation
H Vertical direction
R Rearward direction
V Forward direction
S Lateral direction

The invention claimed is:

1. Seating (1), in particular actively dynamic seating (1), comprising the following:

a. a foot part (2) comprising a pendulum joint (10) which is mounted rotatably with respect to the foot part (2), b. a seat (3) which is mounted rotatably with respect to the foot part (2), c. a pendulum column (4) which carries the seat (3), wherein the pendulum column (4) is rotationally engaged with the pendulum joint (10), d. the pendulum column (4) is formed resiliently in the vertical direction H, and e. anti-rotation components (51, 52, 53) which are provided on the pendulum column (4) and fix the pendulum column (4) in a rotationally engaged manner with respect to the seat (3), in such a way that the pendulum column (4) and the seat (3) can only rotate with respect to the foot part (2) together with the rotatable pendulum joint (10);

f. wherein the anti-rotation components (51, 52, 53) comprise an anti-rotation web (51), and two bearing-bush-side anti-rotation rollers (52, 53) that are each formed with a bearing roller (54, 55) rotatably mounted on a roller cage (57) and having opposite roller end faces (56), and lateral guide faces (59) of the anti-rotation web (51) are arranged between the roller end faces (56) of the bearing rollers (54, 55).

2. Seating according to claim 1, characterised in that the pendulum column (4) further comprises the following:

a. a tubular bearing bush (47), b. a spring leg (40), which can move up and down in the bearing bush (47) and which comprises a pneumatic spring (42), c. a coil spring (15), which is arranged between an upper and lower spring seat (45, 46) of the pendulum column (4), and the height of the lower spring seat (46) being adjustable.

3. Seating according to claim 1, characterised in that at the lower end the pendulum column (4) comprises a tubular bearing bush (47), which is connected to the pendulum joint (10) via a supporting leg (14).

4. Seating according to claim 3, characterised in that the spring leg (40) can move up and down along bearing rollers (58) arranged inside the bearing bush (47).

5. Seating according to claim 2, characterised in that the anti-rotation web (51) extends in the vertical direction H and is arranged externally on the spring leg (40), and is mounted with respect to the bearing-bush-side anti-rotation rollers (52, 53) in such a way that the spring leg (40) can carry out an up-and-down movement in the vertical direction H but not a rotational movement in the bearing bush (47).

6. Seating according to claim 5, characterised in that at least one of the bearing-bush-side anti-rotation rollers (52, 53) forms a rotatable bearing roller (58) which is supported on a roller cage (57).

7. Seating according to claim 6, characterised in that the anti-rotation web (51) on the spring leg (40) forms at least one guide face (59), which is guided along the roller end face (56) of the bearing roller (58) formed by the anti-rotation roller (52) when the spring leg (40) is resiliently actuated in or counter to the vertical direction H.

8. Seating according to claim 2, characterised in that a plurality of bearing rollers (58) are arranged on the bearing bush (47) in such a way that the roller end faces (56) thereof are positioned against the outer surface (41) of the spring leg (40), without play, and the axes of rotation A thereof are each perpendicular to the vertical direction H in such a way that the spring leg (40) can be actuated along the bearing rollers (58) in the vertical direction H.

9. Seating according to claim 2, characterised in that the pneumatic spring (42) is enclosed at least in part by a tubular adapter (60) and non-positively connected thereto.

10. Seating according to claim 9, characterised in that the tubular adapter (60) comprises an aluminum tube, on the inner wall of which plastically deformable structures are formed by means of which the tubular adapter (60) is fixed non-positively on the outer surface of the pneumatic spring (42).

11. Seating according to claim 2, characterised in that the pneumatic spring (42) comprises a first portion (43), on which the pneumatic spring (42) is enclosed by a tubular adapter (60), and a second portion (43), on which the pneumatic spring (42) is rotationally engaged with a seat carrier (6) of the seat (3).

12. Seating according to claim 11, characterised in that the tubular adapter (60) which encloses the pneumatic spring (42) is enclosed by a sliding tube (62) and is rotationally engaged therewith as limited by the anti-rotation components (51, 52, 53), and a lower opening thereof is connected to a metal disc as a central shaft (61) and a lower end (42*a*) of the pneumatic spring (42) being fixed to the central shaft (61).

13. Seating according to claim 2, characterised in that the lower spring seat (46) is fixed to a supporting leg (14) by a first thread (17*a*) by means of a second thread (17*b*) and is adjustable in height H.

14. Seating (1) according to claim 1, characterised in that the seat (3) has an apparatus (16) for defining the rearward direction R and it being possible to deflect the pendulum joint (10) to different extents relative to the orientation of the apparatus (16), and a safety apparatus further being provided which makes a smaller, limited deflection of the pendulum column possible in the rearward direction R by comparison with other directions.

15. Seating (1) according to claim 14, characterised in that the apparatus (16) forms a backrest (7).

16. Seating (1) according to claim 14, wherein the pendulum column (4) is connected to the pendulum joint (10) via a supporting leg (14), and the safety apparatus comprises an articulation bowl (12) that receives the supporting leg (14) in such a way that the supporting leg (14) can carry out pendulum movements inside the articulation bowl (12), and the articulation bowl (12) is provided with a deflection limiting system (13) configured to limit deflection in the rearward direction R.

* * * * *